US005651794A

United States Patent [19]

Taylor

[11] Patent Number: 5,651,794

[45] Date of Patent: Jul. 29, 1997

[54] DYEING OF CELLULOSE

[75] Inventor: James Martin Taylor, Derby, United Kingdom

[73] Assignee: Courtaulds Plc, London, England

[21] Appl. No.: 133,159

[22] PCT Filed: Apr. 24, 1992

[86] PCT No.: PCT/GB91/00768

§ 371 Date: Oct. 15, 1993

§ 102(e) Date: Oct. 15, 1993

[87] PCT Pub. No.: WO92/19807

PCT Pub. Date: Nov. 12, 1992

[30] Foreign Application Priority Data

Apr. 25, 1991 [GB] United Kingdom ..... 9109091

[51] Int. Cl.[6] ..... D01F 2/00; D06P 3/62

[52] U.S. Cl. ..... 8/497; 8/538; 8/654; 8/657; 8/673; 8/918; 8/921

[58] Field of Search ..... 8/497, 921, 654, 8/657, 673, 680, 681, 518, 519, 602, 591, 538, 918; 106/163.1, 164, 165, 168, 169, 186, 198, 204, 902

[56] References Cited

U.S. PATENT DOCUMENTS

| | | | |
|---|---|---|---|
| 1,633,220 | 6/1927 | Mendel | 8/497 |
| 1,997,769 | 10/1935 | Fletcher | 8/497 |
| 3,447,939 | 6/1969 | Johnson . | |
| 3,508,941 | 4/1970 | Johnson . | |
| 3,925,006 | 12/1975 | Forschirm et al. | 8/519 X |
| 5,277,857 | 1/1994 | Nicholson et al. | 264/187 |

OTHER PUBLICATIONS

Trotman, E.R, Dyeing and Chemicial Technology of Fibres, 6th Edition no month available 1984, pp. 353–357.

Derwent Abstract No. 80–286,75C of Russian Patent 679, 657 (Aug. 15, 1979).

*Primary Examiner*—Paul Lieberman

*Assistant Examiner*—Margaret Einsmann

*Attorney, Agent, or Firm*—Davis Hoxie Faithfull & Hapgood

[57] ABSTRACT

Dyed cellulosic regenerated elongate members such as fibers are produced by dyeing the regenerated members with a cationic direct dye after formation but before first drying. A method of producing the dyed elongate members comprises forming a dope containing cellulose or a cellulose compound in solution in a solvent, extruding the dope through at least one orifice into a bath containing water to form an elongate extrudate from which solvent is dissolved and/or the cellulose compound is converted to cellulose so as to form the elongate member, dyeing the formed but never dried elongate member with a cationic direct dye and optionally also with an anionic direct dye and then drying for the first time the dyed elongate member.

18 Claims, 2 Drawing Sheets

DYEING OF CELLULOSE

TECHNICAL FIELD

This invention relates to dyeing and has particular reference to the dyeing of cellulosic elongate members, particularly cellulosic fibres. It has further particular reference to the dyeing of cellulosic fibres spun from a solution containing cellulose or a cellulose compound.

BACKGROUND ART

Cellulosic fibres formed by spinning a solution or dope are well known. Cellulosic fibres of the viscose type have been manufactured for many years by dissolving sodium cellulose xanthate in caustic soda to form a syrup-like spinning solution known as viscose and commonly referred to as a spinning dope. The spinning dope is spun by extruding it through fine holes into a coagulating bath of sulphuric acid and salts which neutralise the alkaline content of the viscose dope and regenerate the original cellulose as continuous filaments. If the orifice through which the viscose dope is extruded is an elongate slit it is possible to manufacture a thin sheet of cellulose. If the orifice is annular it is possible to manufacture a tube of cellulose.

Such cellulosic regenerated elongate members are extremely well known.

In more recent years it has been proposed to manufacture cellulosic regenerated elongate material by forming a true solution of cellulose in a solvent such as a tertiary amine N-oxide. The tertiary amine N-oxide cellulose solution is then extruded into a water bath to dissolve out the amine oxide and to re-form the cellulose in a continuous filament or strip or tube depending on the shape of the orifice through which the material has been extruded.

DISCLOSURE OF THE INVENTION

It has now been discovered that such cellulosic regenerated material may be dyed by a route which in its most preferred form involves very low pollution levels, is very economic and is very quick.

The cellulose solution may be a solution of cellulose in an amine oxide solvent. Examples of such amine oxides are tertiary amine N-oxides such as N-methylmorpholine N-oxide, N,N-dimethylbenzylamine N-oxide, N,N-dimethylethanolamine N-oxide, N,N-dimethylcyclohexylamine N-oxide and the like. The use of amine oxides in processes for dissolving cellulose is disclosed in U.S. Pat. Nos. 3,447,939, 3,508,941 and 4,246,221, the contents of which are included herein by way of reference.

By the present invention there is provided a method of dyeing a cellulosic regenerated elongate member which includes the steps of:

(i) forming a dope containing a material selected from the group consisting of:
  (a) cellulose in solution in a solvent, and
  (b) a cellulose compound in solution in a solvent, (ii) extruding the dope through at least one orifice into a bath containing water to form an elongate extrudate from which either:
  (a) solvent is dissolved to form the cellulosic regenerated elongate member, or
  (b) the cellulose compound is converted to cellulose to regenerate the cellulosic material and thereby form the cellulosic regenerated elongate member, and (iii) drying the cellulosic regenerated elongate member, characterised in that the cellulosic regenerated elongate member is dyed with at least one cationic direct dye after formation but prior to first drying.

A cationic direct dye comprises a long planar molecule containing positively charged groups. The long planar shape to the molecule enables it to lie closely alongside the cellulose molecule and to bond to the molecule by means of van der Waal's forces and hydrogen bonding. The positively charged groups on the dye can bond with $O^-$ ions on the cellulose molecule.

It appears that dyeing the cellulosic member, particularly fibre, after it has been formed but before it has been first dried (herein "never-dried cellulosic material") produces unique and improved properties in the material compared to products which are dyed after first drying. There is also considerable energy saving and saving in chemicals to be achieved, as well as enhanced uniformity of the dyed material.

In addition to treatment of the never-dried cellulosic material with the cationic direct dye, a subsequent treatment with an anionic direct dye may be used to produce further bleed-fastness characteristics by reaction between the anionic and cationic dye molecules.

The present invention also provides a cellulosic regenerated elongate member which has been dyed with a cationic direct dye whilst still in the never-dried condition.

The pH of the solution for the cationic direct dye may for example be pH 3, pH 4, pH 4.5, pH 5, pH 6, pH 7, pH 8, pH 9, or pH 10. The dyestuffs may be applied at ambient temperature or at an elevated temperature. The elevated temperature may for example be 30°, 40°, 50°, 60° or 70° C. Alternatively, the elevated temperature may be closer to the boiling point.

The cationic direct dyes may be applied directly from water or from any other suitable solvent. Preferably the solvent is an aqueous solvent.

The present invention further provides that the dyed cellulosic material may be dried as a continuous tow and cut to staple after drying or may be cut wet to form staple and dried as staple.

Suitable cationic direct dyes for carrying out the invention are those dyes available from Sandoz under the trade names "Cartasol Yellow K-GL", "Cartasol Turquoise K-GL", "Cartasol Yellow K-3GL", "Cartasol Orange K-3GL", "Cartasol Blue K-RL", "Cartasol Red K-2BN" and "Cartasol Brilliant Scarlet K-2GL". Suitable dyes are also available from BASF under the trade names "Fastusol Yellow 3GL" and "Fastusol C Blue 74L". "Cartasol" and "Fastusol" are believed to be Registered Trade Marks.

Other cationic direct dyes may be simply tested to see if they give satisfactory levels of fastness for both light and wash tests.

BRIEF DESCRIPTION OF THE DRAWINGS

By way of example embodiments of the present invention will now be described with reference to the accompanying drawings, of which.

Figure 1:
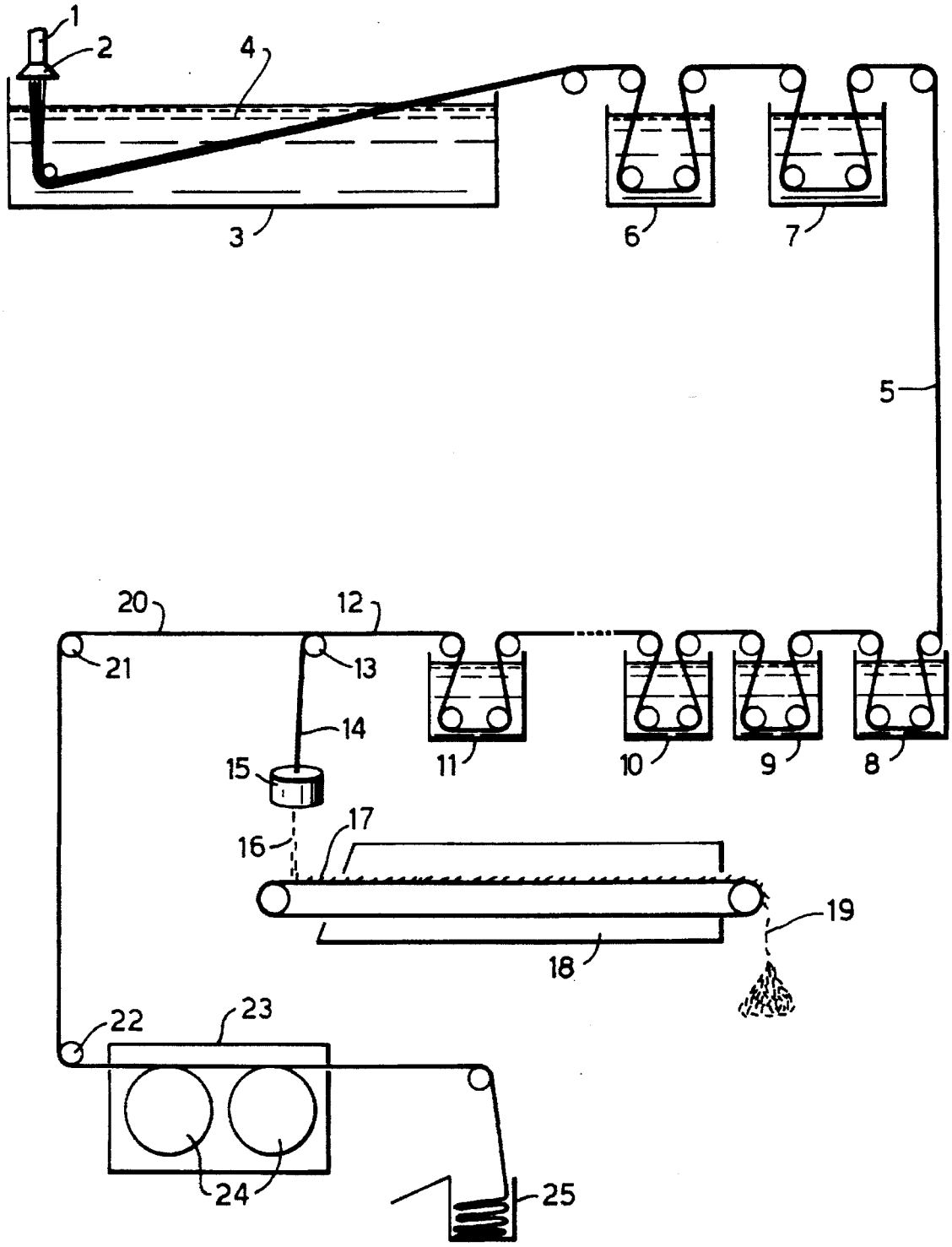
FIG. 1 is a schematic view of a spinning, dyeing and drying system in accordance with the present invention.

In all of the tests referred to below the fibres were dyed under laboratory conditions. A predetermined percentage of dye was pipetted from a stock solution into a jar and a standard volume of water added. If the pH was required to be higher than 7 sodium carbonate was added to increase the pH; if the pH was required to be lower than 7 acetic acid was added to reduce the pH. The dye solutions were then heated to the predetermined temperature. The tests were then carried out by putting into the jar the fibre which also had been heated to the same temperature as the solution, sealing the jar and shaking until maximum exhaustion of the solution was achieved. Typically, dyeings took between 20 seconds and 3 minutes to reach a maximum exhaustion. It should be noted that these laboratory scale dyeings take longer than real on-line dyeing because the concentration of the dyestuff in the dye bath is much greater in on-line dyeing. The time period of 20 seconds to 3 minutes on a laboratory scale corresponds to a satisfactory speed for on-line continuous dyeing of never-dried fibres.

It should be noted that no additions of salt (sodium chloride) were made to the dyestuffs.

After dyeing, the fibres were rinsed under cold running water until no more dyestuff was apparent in the water. For wash-fastness tests the samples were heated to 60° C. in a mixture of soap and sodium carbonate in accordance with the ISO 3 standard wash-fastness tests. To determine light-fastness the samples were rated against the British Society of Dyers and Colourists blue scale in which the higher the number the more resistant is the material to light-fading. On a practical basis it is generally accepted that materials having a light-fastness of 4 are acceptable for apparel purposes. The light-fastness tests were carried out to standard 5 only—suitable for apparel purposes.

Table I below shows the results of a series of 3 dyes carried out on never-dried fibre under a series of alternative pH conditions.

TABLE I

| | Light | Fastness on Fibre | | Dyeing |
|---|---|---|---|---|
| Dye | Fastness on Paper | Light | Wash ISO 3 | Conditions on Fibre |
| Cartasol Blue K-RL (tietall complex Dye) | 2–3 | a) 3–4<br>b) 3–4 | a) Good<br>b) Good | a) Room Temp. pH 4.5<br>b) Room Temp. pH 8.0 |
| Cartasol Turquoise K-GL (Phthalo-cyanine Metal Complex Dye) | 2–3 | 4–5 | Good | Room Temp. pH 4.5 |
| Cartasol Yellow K-GL (Cationic Azo Dye) | 3 | a) 5<br>b) 5 | Not tested | a) Room Temp. pH 4.5<br>b) Room Temp. pH 5.5. |

By comparison, the light-fastness of the same dyes on paper is given and it can be seen that the dyes do not produce the same degree of light-fastness on paper. Paper is a cellulosic material which may be regarded as pre-dried. It can be seen therefore that although the cationic direct dyes do not produce a particularly light-fast result on paper they do produce light-fast results which are acceptable for apparel purposes on never-dried cellulosic materials.

It is not clear why the cationic direct dyes shown in Table I produce better results on never-dried fibre compared to paper. Given that the dyes are believed to react with the fibre and to bond to the fibre by van der Waal's forces it is not at all clear why this difference should appear. If the light-fastness of the dyes on paper were to be taken as indicative it would not be acceptable to use these dyes on fibres for use in apparel. Fortunately, however, it has been discovered that the cationic direct dyes do produce a simple means of dyeing cellulosic material on-line in the never-dried condition. Prior to the making of the present invention it had not proved to be a practical business to dye cellulosic regenerated fibres on-line. Typically, cellulosic fibres have been dyed after manufacture into fibre or as fabric or as yarn.

A further important factor in the use of a practical dyestuff is the ability of the dye to resist backstaining when dyed fibre is washed with another material. Thus, if dyed cellulosic material is washed with a nylon material it is important that the dye does not transfer to the nylon and stain the nylon in the wash. The normal method of determining this backstaining is to wash a mixture of dyed fibres and fibres of another material in an ISO 3 wash test and determine the staining of the other material. In such a test values of 3–4 are acceptable for most apparel uses and a value of 5 is normally considered suitable for all apparel uses.

Backstaining test results are given in Table II below. Also included in Table II are light-fastness tests. It can be seen that although Brown K-BL has good backstaining test results, better than Blue K-RL except on nylon, its light-fastness results are not quite as good. It will be appreciated that for a dye to be commercially acceptable a balance of properties is required and that, because of the complexity of dyestuff chemistry, occasionally one or more dyestuffs in a class will not have the complete range of properties required even though the remaining dyestuffs in that class have an acceptable balance. Such oddities can easily be determined by experiment and do not detract from the value of the invention as a whole.

TABLE II

| | | Backstaining Wash Test (ISO 3) | | | | | | Light Test | |
|---|---|---|---|---|---|---|---|---|---|
| Cortasol dyes | pH | Acetate | Cotton | Nylon | Polyester | Acrylic | Wool | (Fibre) | (Paper) |
| Turquoise K-GL (phthalocyanine metal complex) | 5.5 | 4–5 | 4 | 4–5 | 4–5 | 4–5 | 4–5 | 4–5 | 2–3 |
| Red K-2BN (azo) | 8.0 | 4–5 | 4 | 4 | 4–5 | 4–5 | 4–5 | 3–4 | 2 |

TABLE II-continued

| | | Backstaining Wash Test (ISO 3) | | | | | | Light Test | |
|---|---|---|---|---|---|---|---|---|---|
| Cortasol dyes | pH | Acetate | Cotton | Nylon | Polyester | Acrylic | Wool | (Fibre) | (Paper) |
| Blue K-RL (metal complex) | 8.0 | 4–5 | 3 | 4–5 | 4–5 | 4–5 | 4–5 | 3–4 | 2–3 |
| Brown K-BL (azo metal complex) | 8.0 | 4–5 | 4–5 | 3–4 | 4–5 | 4–5 | 4–5 | 1–2 | 2 |

In Table II all dyestuffs were applied to the solvent-spun cellulosic fibre at 1% by weight of dry fibre. The dyestuffs were applied at room temperature and at the pH identified in the Table. In the case of the backstain wash test, 1 g of dyed solvent-spun cellulosic fibre was washed as a hank in a standard ISO 3 wash programme with an SDC (Society of Dyers and Colourists) multifibre strip, 4 cm long, of undyed, nominally white, fibres of the materials specified. After washing, the multifibre strip was dried and examined for backstaining.

It is also possible to treat the never-dried fibre with cationic direct dyes and subsequently to treat with anionic direct dyes such as Pergasol dyes. (Pergasol is believed to be a Registered Trade Mark.) The two dyes then react to form effectively a pigment embedded firmly in the fibre.

Attempts were made to see whether dyes of other types than cationic direct dyes could be used to dye on a continuous basis cellulosic never-dried fibres. A range of basic dyes was applied to cellulosic never-dried fibre at pH 5.5. The dyes were substantive to the fibre in that they were attracted to the fibre. Unfortunately, however, they had little or no affinity for the fibre as they rinsed out almost completely under cold running water. As the dyes rinsed out so completely no wash- or light-fastness tests were carried out. The following dyes were tried as typical basic dyes:

Astrazon Golden Yellow GLE—C.I. Basic Yellow 28

Yoracryl Red BGL—C.I. Basic Red 46

Astrazon Red GTLN—C.I. Basic Red 18

Maxilon Blue GRL—C.I. Basic Blue 41

(Astrazon, Yoracryl and Maxilon are believed to be Registered Trade Marks.) Attempts were also made to see whether anionic direct dyes would dye never-dried cellulosic fibrous material in the absence of cationic direct dyes. A range of Pergasol dyes available from Ciba-Geigy and a Paramine dye available from Holliday were applied to never-dried cellulosic fibre. (Paramine is believed to be a Registered Trade Mark.) Tests at pH 5 carried out at room temperature indicated that only pale dyeing of the cellulosic fibre was obtained. Increasing the pH to 8 gave better results but still not as good as cationic direct dyeing. The following anionic direct dyes were tested:

Pergasol Orange 5R—C.I. Direct Orange 29 (azo)

Pergasol Yellow GA—C.I. Direct Yellow 1373 (azo)

Pergasol Turquoise R—C.I. Direct Blue 199 (phthalocyanine)

Pergasol Red 2G—C.I. Direct Red 329 (azo)

Pergasol Red 2B—C.I. Direct Red 254 (disazo)

Paramine Yellow R

The present invention therefore permits continuous on-line dyeing of never-dried cellulosic material.

A preferred material for on-line dyeing is the solvent-spun cellulosic fibre. A process suitable for carrying out the invention is illustrated in FIG. 1 of the accompanying drawings.

A mixture of cellulose, solvent such as amine oxide and water is prepared. The mixture is prepared as a slurry and then is heated under vacuum to boil off the water. The result of this is that the cellulose goes into solution in the amine oxide to form a dope. Such processes for the manufacture of a solution of cellulose in a solvent are well described in the literature. The solution, commonly referred to as a dope, is then injected through a pipe 1 into a jet assembly 2 containing many fine holes. The jet assembly 2 is positioned over a water bath 3 containing warm water 4. On emerging from the jet 2 the solution of cellulose in amine oxide forms a plurality of gel strands and, as the amine oxide dissolves in the water bath 4, the gel strands form a plurality of filaments 5 of cellulose. The cellulose then passes through a series of water baths 6, 7 to remove more of the amine oxide. The filament 5 passes into a bleach bath 8 and is then washed in a series of baths such as bath 9 before passing into a dye bath 10. The dye bath 10 contains a solution of a suitable dye such as Cartasol Blue K-RL, the exact concentration depending on the depth of shade required. After dyeing the never-dried filament, it is passed through a soft-finish bath 11 before being passed to a drying system.

Two drying systems are shown in FIG. 1. The first drying system involves filament 12 passing around a pulley 13 to descend vertically as at 14 into a staple cutter head 15. The wet filament 14 is cut by the head 15 to form staple fibre 16 which is passed onto a moving bed 17 and then into a drying tunnel 18. The dried staple fibre falls off the end of the bed as at 19 and is passed to a suitable packing machine.

Alternatively, the dyed filament may be passed along route 20 around pulleys 21 and 22 and then be dried as a continuous tow in a drying oven 23 on heated drums 24. It can then either be plaited into a suitable packing container 25 as a dry continuous tow of filaments or cut to form staple for subsequent processing as a staple fibre.

A particular advantage of the route in which the fibre is dried as tow and then cut to staple, as opposed to cutting whilst wet and drying, is that it is easier to change colours whilst minimising contamination of fibre of one colour with fibre of another colour. If coloured fibre is cut wet and dried, it is a very difficult and slow process to clean out the staple fibre dryers before a different colour is dried. Contamination of the new colour fibre with the old is highly likely even if the dryer is manually vacuum-cleaned between colours.

Drying the fibre in tow form means that only the fibre cutter and downstream of the cutter has to be cleaned—a very much simpler operation and one which means that the time spent with the machinery stopped between colours is much lower on fibre dried as tow as compared to fibre dried as staple.

A further advantage of the colouring process of the invention, compared to pigmentation processes used heretofore to colour viscose rayon cellulosics, is that the colours can be changed more rapidly, because the pigmentation route requires the pigment to be incorporated in the dope prior to spinning. Only certain pigments are suitable for incorporation in the dope, and the range of colours of such viscose rayon fibres is limited. It has also been normal practice with viscose fibre staple products to dry the fibre in staple form. This results in the contamination problem referred to above.

It will be appreciated that by means of the present invention the colouring of the fibre may be accomplished at little expense beyond the mere cost of the dye. The washing baths used may simply be incorporated into the wash line for the fibre, and cationic direct dyes dye the never-dried cellulosic fibre to a high standard of light- and wash-fastness with little production of unwanted waste chemical products.

Figure 2:
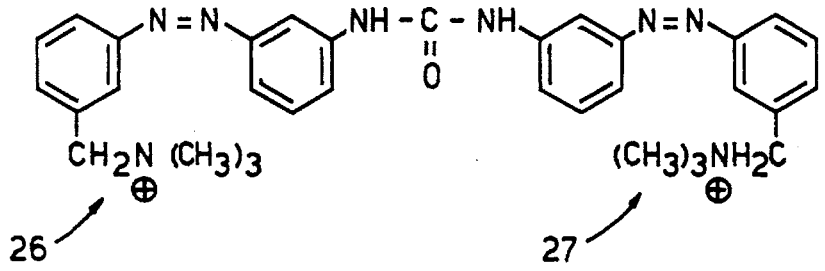
FIG. 2 is a typical cationic direct dye structure.
Figure 3:
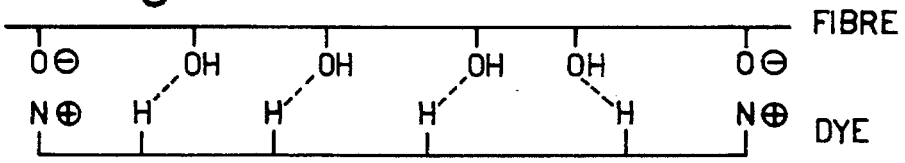
FIG. 3 is a schematic view of hydrogen bonding occurring with a fibre structure and a cationic direct dye.
Figure 4:
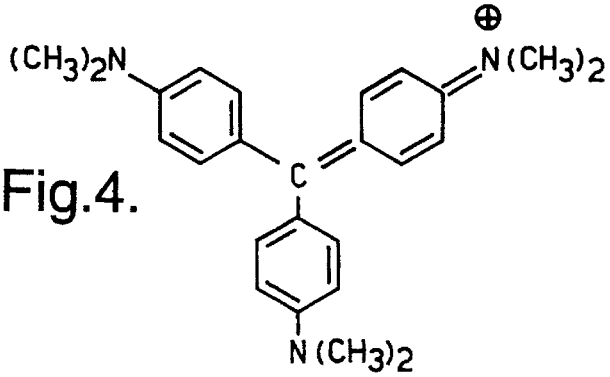
FIG. 4 is a typical basic dye structure.
Figure 5:
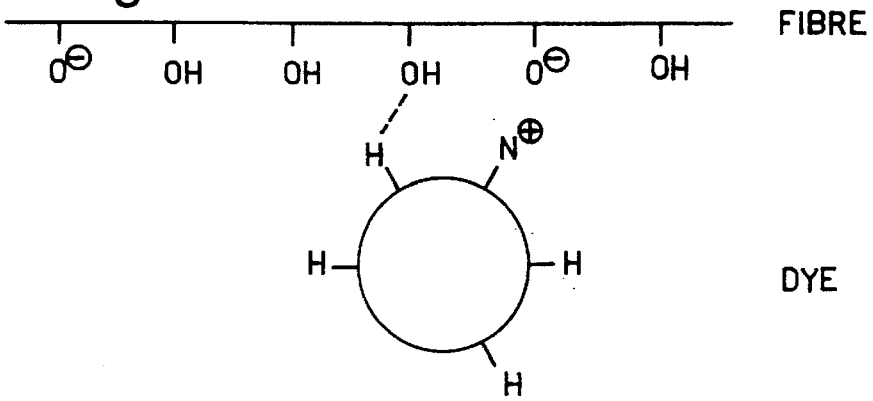
FIG. 5 shows hydrogen bonding of a basic dye to a schematic fibre structure.

By way of identification a typical cationic direct dye structure is shown in FIG. 2 of the drawings and it can be seen that the molecule is essentially a planar molecule having cationic dye sites at 26, 27 whereby the dye may bond to the anionic sites on the fibre. Schematically the hydrogen or van der Waal's bonding of the cationic direct dye is illustrated in FIG. 3. For comparison, a typical basic dye structure is shown in FIG. 4 and it can be seen that the physical structure of the dye is such that it cannot easily bond to the cellulosic molecule. A schematic arrangement of the basic dye bonding to the fibre is shown in FIG. 5. It is believed that it is the physical failure of the basic dye to form a plurality of hydrogen bonds with the cellulose which results in poor fastness of the dye to the cellulose molecule.

I claim:

1. A method of manufacturing a dyed cellulosic regenerated elongate member which includes the steps of:

(i) forming a dope selected from the group consisting of:
  (a) cellulose in solution in a solvent, and
  (b) a cellulose compound in solution in a solvent;

(ii) extruding said dope through at least one orifice into a water-containing bath to form an elongate extrudate;

(iii) producing said cellulosic regenerated elongate member by respectively either:
  (a) dissolving said solvent out of said elongate extrudate into said bath, or
  (b) regenerating said cellulose compound to form cellulose;

(iv) dyeing said cellulosic regenerated elongate member with at least one planar molecular cationic direct dye; and (v) drying said cellulosic regenerated elongate member for the first time, said dyed cellulosic regenerated elongate member having a backstaining resistance of at least 4 measured by the ISO 3 wash test.

2. A method as claimed in claim 1 further including the step of dyeing said cellulosic regenerated elongate member with an anionic direct dye subsequent to said dyeing step (iv) and prior to said drying step (v).

3. A method as claimed in claim 1 wherein said cellulosic regenerated elongate member is dyed with an aqueous solution of said cationic direct dye, the pH of said aqueous solution being in the range 3 to 10.

4. A method as claimed in claim 1 wherein said cellulosic regenerated elongate member is dyed with an aqueous solution of said cationic direct dye, the temperature of said aqueous solution being in the range ambient temperature to 70° C.

5. A method as claimed in claim 1 wherein said cellulosic regenerated elongate member is dyed with an aqueous solution of said cationic direct dye, said aqueous solution being essentially free of added sodium chloride.

6. A method as claimed in claim 1 wherein said dope is a solution of cellulose in a solvent, said solvent comprising a tertiary amine N-oxide.

7. A method as claimed in claim 6 wherein said tertiary amine N-oxide is selected from the group consisting of N-methylmorpholine N-oxide; N,N-dimethylbenzylamine N-oxide; N, N-dimethylethanolamine N-oxide and N,N-dimethylcyclohexylamide N-oxide.

8. A method according to claim 1 wherein said cellulosic regenerated elongate member consists of fibres.

9. A method as claimed in claim 8 wherein said fibres have the form of a continuous tow in said drying step (v).

10. A method as claimed in claim 9 wherein said continuous tow is cut to form staple fibres subsequent to said drying step (v).

11. A dyed cellulosic regenerated elongate member having a backstaining resistance of at least 4 measured by the ISO 3 wash test and having been dyed in the never-dried condition with a planar molecular cationic direct dye.

12. A dyed cellulosic regenerated elongate member as claimed in claim 11 having been further dyed with an anionic direct dye in said never-dried condition subsequent to said dyeing with said cationic direct dye.

13. A dyed cellulosic regenerated elongate member as claimed in claim 11 which consists of staple fibres.

14. A dyed cellulosic regenerated elongate member as claimed in claim 11 which has been prepared from a solution of cellulose in a solvent.

15. A dyed cellulosic regenerated elongate member as claimed in claim 14 wherein said solvent is a tertiary amine N-oxide.

16. A dyed cellulosic regenerated elongate member as claimed in claim 15 wherein said tertiary amine N-oxide is selected from the group consisting of N-methylmorpholine N-oxide; N, N-dimethylbenzylamine N-oxide; N,N-dimethylethanolamine N-oxide and N, N-dimethylcyclohexylamine N-oxide.

17. A dyed cellulosic regenerated elongate member as claimed in claim 11 which consists of continuous filaments.

18. A dyed cellulosic regenerated elongate member as claimed in claim 11 which consists of a thin sheet or tube.

* * * * *